US005383665A

United States Patent [19]

Schultz et al.

[11] Patent Number: 5,383,665

[45] Date of Patent: Jan. 24, 1995

[54] GOLF CHIPPING GAME APPARATUS

[76] Inventors: Joseph M. Schultz; Teresa A. Schultz, both of 1802 S. 246th Pl., Des Moines, Wash. 98198

[21] Appl. No.: 205,168

[22] Filed: Mar. 3, 1994

[51] Int. Cl.[6] ..... A63B 69/36

[52] U.S. Cl. ..... 273/176 A; 273/176 FB; 273/178 B; 273/185 R; 273/181 A

[58] Field of Search ..... 273/176 R, 176 A, 176 B, 273/176 F, 176 FA, 176 FB, 176 J, 178 R, 178 B, 181 R, 181 A, 185 R

[56] References Cited

U.S. PATENT DOCUMENTS

| | | | |
|---|---|---|---|
| 1,761,039 | 6/1930 | Hazeltine | 273/185 R |
| 3,643,959 | 2/1972 | Cornell et al. | 273/185 R X |
| 3,784,207 | 1/1974 | Gentiluomo | 273/185 R X |
| 3,936,055 | 2/1976 | Scott | 273/178 B X |
| 4,336,939 | 6/1982 | Krumlauf | 273/185 R |
| 5,002,280 | 3/1991 | Hines | 273/178 B |
| 5,016,891 | 5/1991 | Nelson | 273/407 |
| 5,090,704 | 2/1992 | Dona | 273/177 R |
| 5,127,654 | 7/1992 | Thackery | 273/200 B X |
| 5,163,684 | 11/1992 | Seidler | 273/181 A |
| 5,181,721 | 1/1993 | Halliburton | 273/177 A |

*Primary Examiner*—George J. Marlo

[57] ABSTRACT

A new and improved golf chipping game apparatus includes a ball-hitting assembly and a target assembly. The target assembly includes a first target region which has a first surface area and a second target region which has a second surface area. The second surface area is less than the first surface area. The ball-hitting assembly and the target assembly are laid out flat on a ground or floor surface in a playing mode. A connection assembly is provided for connecting the ball-hitting assembly to the target assembly in a storage mode. The connection assembly also includes a hinge assembly connected between an edge portion of the ball-hitting assembly and an edge portion of the target assembly. The target assembly includes a layer of cushion material which comprises the first target region and the second target region. A first ring of cushion material is placed on the layer of cushion material and defines a boundary between the first target region and the second target region. A second ring of cushion material is placed on the layer of cushion material and defines an outer boundary of the first target region. A first handle assembly is connected to the ball-hitting assembly, and a second handle assembly is connected to the target assembly. The first handle assembly and the second handle assembly are placed in registration when the ball-hitting assembly and the target assembly are connected together in the storage mode.

6 Claims, 3 Drawing Sheets

GOLF CHIPPING GAME APPARATUS

BACKGROUND OF THE INVENTION

1. Field of the Invention

The present invention relates generally to games and, more particularly, to a game for simulating a number of the aspects of the game of golf.

2. Description of the Prior Art

The game of golf is a very popular game. There are millions of amateur golfers in the United States, and there are approximately 9,000 professional golfers. Often a golf course is quite a distance from a person's home. Moreover, a golf course consists of 18 holes. To pay on a golf course requires either a membership at a golf course or the payment of fee. For such reasons, a person may not wish to play on a golf course, and for such reasons simulated golf games have been developed.

Throughout the years, a number of innovations have been developed relating to simulations of various aspects of the game of golf, and the following U.S. patents are representative of some of those innovations: U.S. Pat. Nos. 5,090,704; 5,127,654; 5,163,684; and 5,181,721. More specifically, U.S. Pat. No. 5,090,704 discloses a golf game target which include ring shaped targets intended to receive balls therethrough in a horizontal manner. Such a target permits a simulation of putting and practice for putting skills. However, such a target does not either permit a simulation of chipping or permit practice of chipping skills. Chipping requires accuracy in a substantially vertical placement of a ball rather than the horizontal ball placement required by putting.

U.S. Pat. No. 5,127,654 discloses a golf clubhead target. In using this target, the target requires an accurate are in swinging the club. However, proper control of swinging force is not required for this device. In this respect, it would be desirable if a golf skills practice device were provided which gave practice in the swinging force of a golf club.

U.S. Pat. No. 5,163,684 discloses a chip shot practice ring. With this device a single ring is provided for receipt of a golf ball hit with a chip shot. However, to provide a gradation of chip shot skills, it would be desirable if a chip shot practice device were provided with plural target areas requiring different levels of target skill. Moreover, this device provides a vertically extending flag and a self-contained source of illumination. Such a flag and source of illumination are unnecessary complexities. In this respect, it would be desirable if a chip shot practice device were provided without a flag and without a self-contained source of illumination. Although the device in this cited patent provides a target for chip shots, it does not provide a platform upon which the chip shot is hit. In this respect, it would be desirable if a chip shot practice device were provided which includes a platform upon which a chip shot is hit. Although this cited device provides a practice device for chip shots, there is no disclosure of a competitive game that involves chip shots. To add interest and to provide a new form of recreation, it would be desirable of a golf game were provided that is based on competition in chip shots.

U.S. Pat. No. 5,181,721 discloses that includes a computing mechanism and three targets that are tilted when hit by horizontally travelling balls. In view of the very complex nature of this cited device, it would be desirable if a chip shot practice device were provided which did not include a complex computing mechanism.

U.S. Pat. No. 5,016,891 may also be of interest for its disclosure of a projectile-target game apparatus that includes a hand-held projectile tossed at a target. The target can be used as a simulated golf hole.

Still other features would be desirable in a golf chipping game apparatus. It would be desirable if a game device were provided in which a chip shot hitting platform and a chip shot target can be folded up into a compact combination for storage. Moreover, for a game involving two or more players, it would be desirable if two sets of hitting platforms and targets were provided, and these two sets can be placed on the ground a predetermined distance apart from each other. In addition, for a golf chipping game that can be played competitively between two or more players, it would be desirable if game rules and a scoring system were provided for the game.

Thus, while the foregoing body of prior art indicates it to be well known to use devices that simulate a number of the aspects of the game of golf, the prior art described above does not teach or suggest a golf chipping game apparatus which has the following combination of desirable features: (1) permits a simulation of chipping and permits practice of chipping skills; (2) gives practice in controlling the swinging force of a golf club; (3) in a specific target, provides plural target areas requiring different levels of targeting skill; (4) does not include a flag and does not include a self-contained source of illumination; (5) includes a platform upon which a chip shot is hit; (6) provides a golf game that is based on competition in chip shots; (7) does not include a complex computing mechanism; (8) provides a chip shot hitting platform and a chip shot target that can be folded up into a compact combination for storage; (9) provides two sets of hitting platforms and targets; and (10) provides a golf chipping game that can be played competitively between two or more players and provides game rules and a scoring system for the game. The foregoing desired characteristics are provided by the unique golf chipping game apparatus of the present invention as will be made apparent from the following description thereof. Other advantages of the present invention over the prior art also will be rendered evident.

SUMMARY OF THE INVENTION

To achieve the foregoing and other advantages, the present invention, briefly described, provides a new and improved golf chipping game apparatus which includes a ball-hitting assembly which includes a ball-receiving surface. A target assembly is provided for receiving a golf ball hit from the ball-hitting assembly. The target assembly includes a first target region which has a first surface area and a second target region which has a second surface area. The second surface area is less than the first surface area. The ball-hitting assembly and the target assembly are laid out flat on a ground or floor surface in a playing mode. A connection assembly is provided for connecting the ball-hitting assembly to the target assembly in a storage mode.

. The connection assembly includes a hinge assembly connected between an edge portion of the ball-hitting assembly and an edge portion of the target assembly.

The target assembly includes a layer of cushion material which comprises the first target region and the second target region. A first ring of cushion material is placed on the layer of cushion material. The first ring of cushion material defines a boundary between the first target region and the second target region. A second ring of cushion material is placed on the layer of cushion material. The second ring of cushion material defines an outer boundary of the first target region.

A first handle assembly is connected to the ball-hitting assembly at a first peripheral location of the ball-hitting assembly. A second handle assembly is connected to the target assembly at a second peripheral location of the target assembly. The first handle assembly and the second handle assembly are placed in registration when the ball-hitting assembly and the target assembly are connected together in the storage mode.

The connection assembly includes a handle connection assembly for connecting the first handle assembly with the second handle assembly when the ball-hitting assembly and the target assembly are in the storage mode.

The above brief description sets forth rather broadly the more important features of the present invention in order that the detailed description thereof that follows may be better understood, and in order that the present contributions to the art may be better appreciated. There are, of course, additional features of the invention that will be described hereinafter and which will be for the subject matter of the claims appended hereto.

In this respect, before explaining a preferred embodiment of the invention in detail, it is understood that the invention is not limited in its application to the details of the construction and to the arrangements of the components set forth in the following description or illustrated in the drawings. The invention is capable of other embodiments and of being practiced and carried out in various ways. Also, it is to be understood, that the phraseology and terminology employed herein are for the purpose of description and should not be regarded as limiting.

As such, those skilled in the art will appreciate that the conception, upon which disclosure is based, may readily be utilized as a basis for designing other structures, methods, and systems for carrying out the several purposes of the present invention. It is important, therefore, that the claims be regarded as including such equivalent constructions insofar as they do not depart from the spirit and scope of the present invention.

Further, the purpose of the foregoing Abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. Accordingly, the Abstract is neither intended to define the invention or the application, which only is measured by the claims, nor is it intended to be limiting as to the scope of the invention in any way.

It is therefore an object of the present invention to provide a new and improved golf chipping game apparatus which has all of the advantages of the prior art and none of the disadvantages.

It is another object of the present invention to provide a new and improved golf chipping game apparatus which may be easily and efficiently manufactured and marketed.

It is a further object of the present invention to provide a new and improved golf chipping game apparatus which is of durable and reliable construction.

An even further object of the present invention is to provide a new and improved golf chipping game apparatus which is susceptible of a low cost of manufacture with regard to both materials and labor, and which accordingly is then susceptible of low prices of sale to the consuming public, thereby making such golf chipping game apparatus available to the buying public.

Still yet a further object of the present invention is to provide a new and improved golf chipping game apparatus which permits a simulation of chipping and permits practice of chipping skills.

Still another object of the present invention is to provide a new and improved golf chipping game apparatus that gives practice in controlling the swinging force of a golf club.

Yet another object of the present invention is to provide a new and improved golf chipping game apparatus which in a specific target, provides plural target areas requiring different levels of targeting skill.

Even another object of the present invention is to provide a new and improved golf chipping game apparatus that does not include a flag and does not include a self-contained source of illumination.

Still a further object of the present invention is to provide a new and improved golf chipping game apparatus which includes a platform upon which a chip shot is hit.

Yet another object of the present invention is to provide a new and improved golf chipping game apparatus that provides a golf game that is based on competition in chip shots.

Still another object of the present invention is to provide a new and improved golf chipping game apparatus which does not include a complex computing mechanism.

Yet another object of the present invention is to provide a new and improved golf chipping game apparatus that provides a chip shot hitting platform and a chip shot target that can be folded up into a compact combination for storage.

Still a further object of the present invention is to provide a new and improved golf chipping game apparatus that provides two sets of hitting platforms and targets.

Yet another object of the present invention is to provide a new and improved golf chipping game apparatus which provides a golf chipping game that can be played competitively between two or more players and provides game rules and a scoring system for the game.

These together with still other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there are illustrated preferred embodiments of the invention.

BRIEF DESCRIPTION OF THE DRAWINGS

The invention will be better understood and the above objects as well as objects other than those set forth above will become more apparent after a study of the following detailed description thereof. Such description makes reference to the annexed drawing wherein.

DESCRIPTION OF THE PREFERRED EMBODIMENT

With reference to the drawings, a new and improved golf chipping game apparatus embodying the principles and concepts of the present invention will be described.

Figure 1:
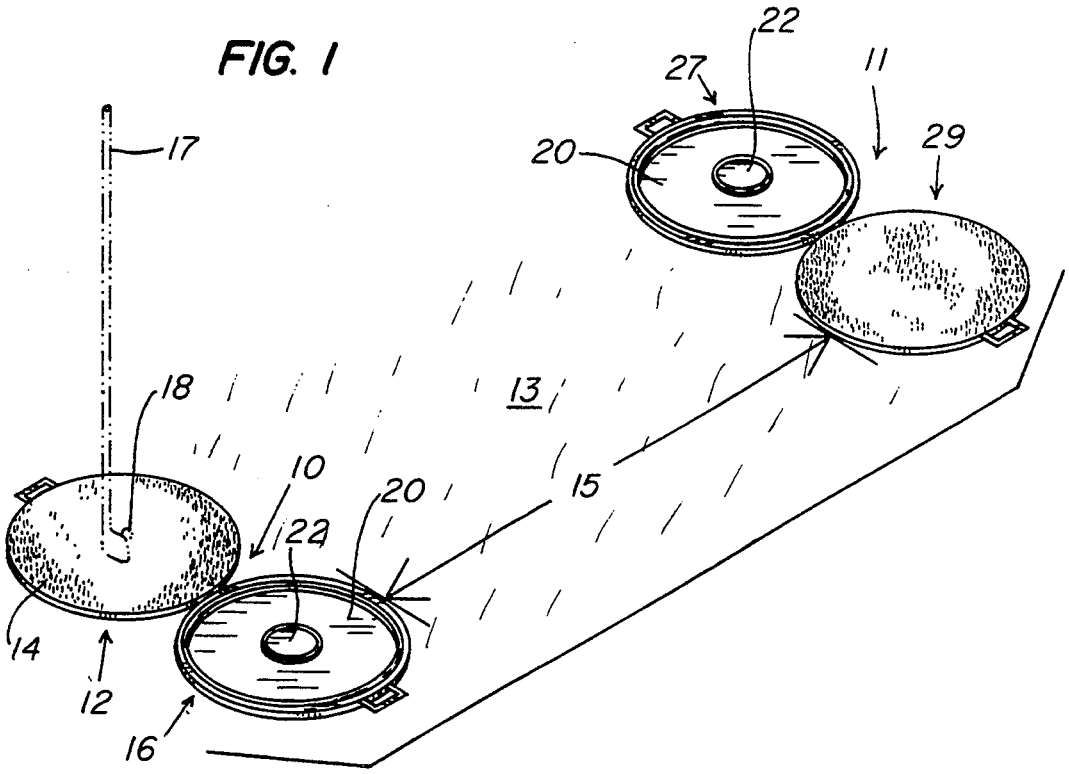
FIG. 1 is a perspective view showing a pair of preferred embodiments of the golf chipping game apparatus of the invention separated a predetermined distance for a competitive game between two or more opponents.
Figure 2:
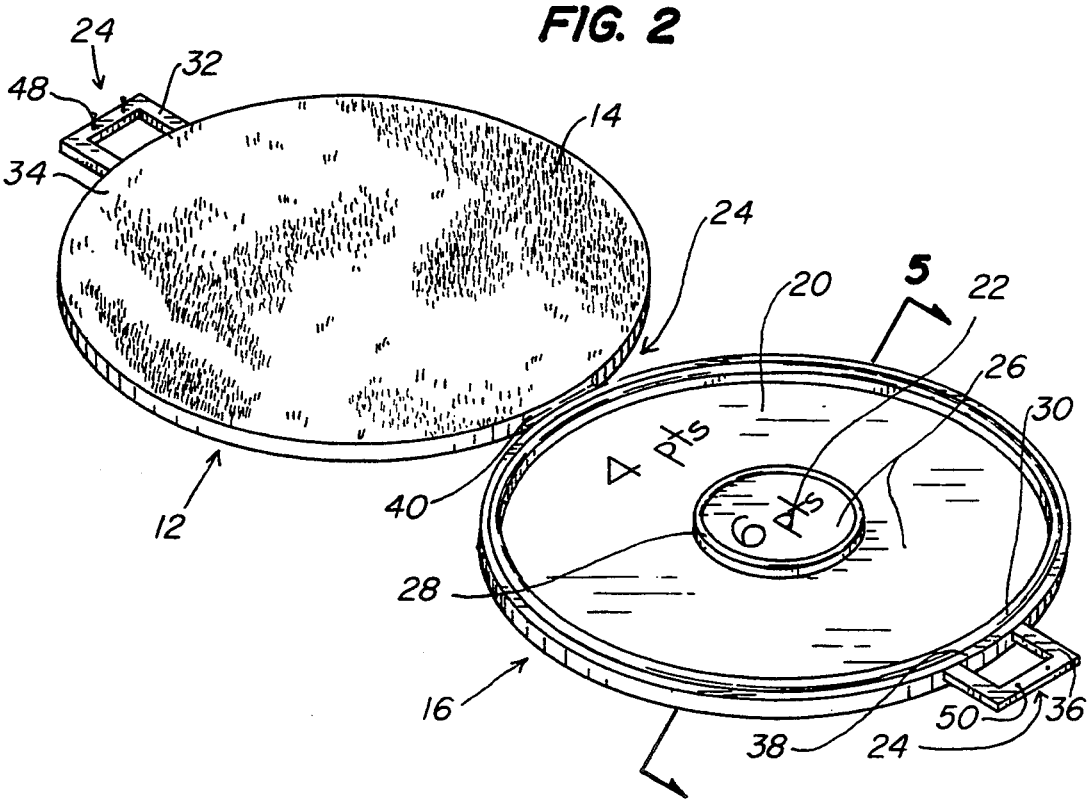
FIG. 2 is an enlarged perspective view of one of the pair of embodiments of the invention shown in FIG. 1 in an open position for playing.
Figure 3:
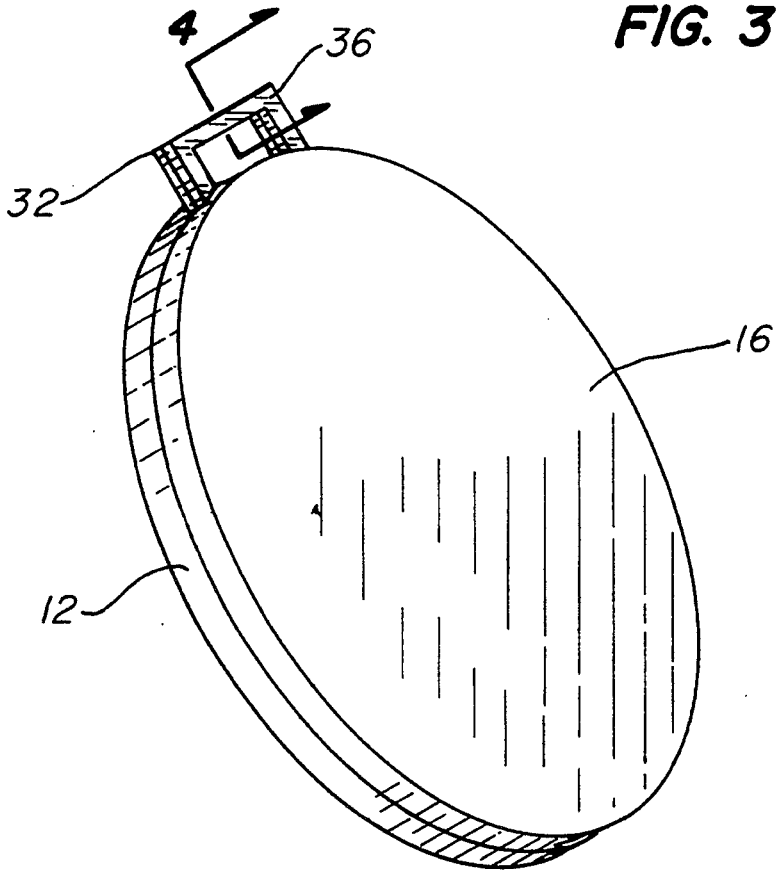
FIG. 3 is a perspective view of the embodiment of the invention shown in FIG. 2 in a folded position for carrying and storage.
Figure 4:
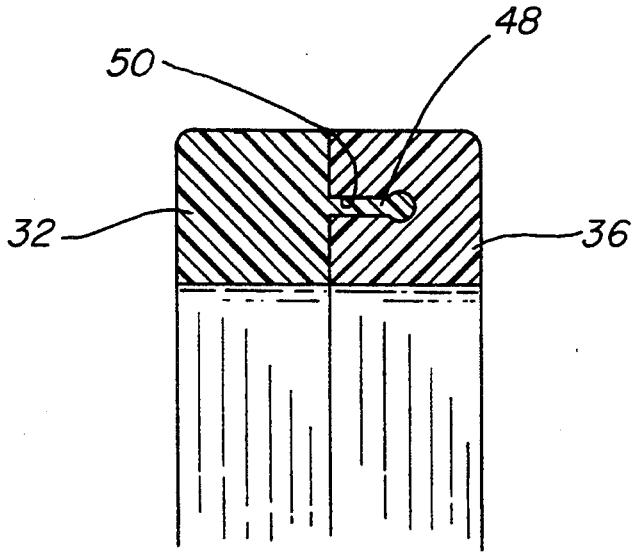
FIG. 4 is an enlarged cross-sectional view of the handle portion of the embodiment of the invention shown in FIG. 3 taken along line 4—4 of FIG. 3.
Figure 5:
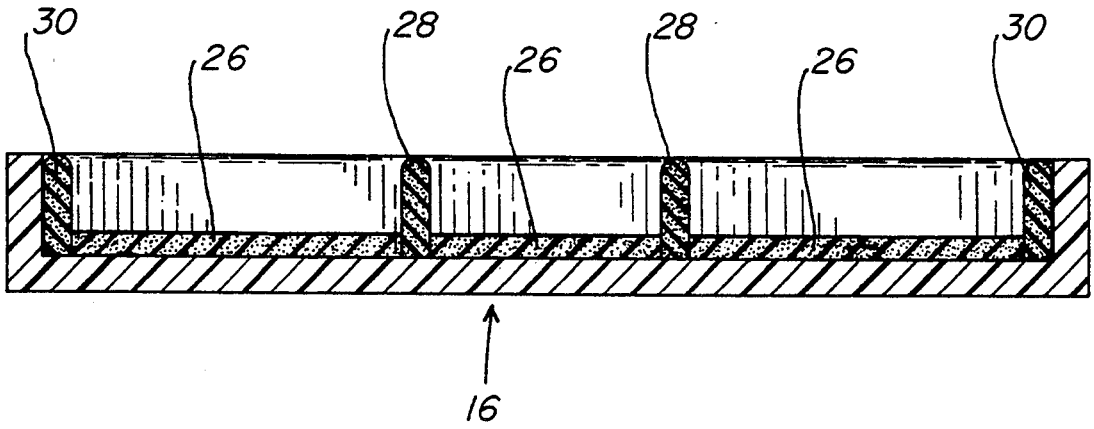
FIG. 5 is an enlarged cross-sectional view of the target portion of the embodiment of the invention shown in FIG. 1 taken along line 5—5 of FIG. 2.
Figure 6:
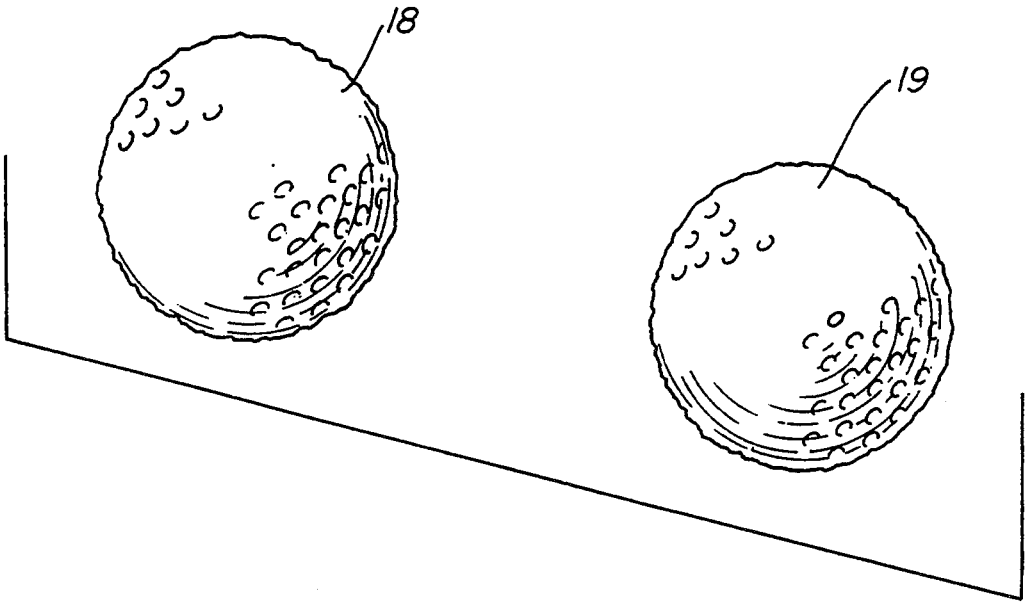
FIG. 6 is a perspective view of a pair of golf balls used with the golf chipping game apparatus of the invention.

Turning to FIGS. 1–6, there is shown an exemplary embodiment of the golf chipping game apparatus of the invention generally designated by reference numeral 10. In its preferred form, golf chipping game apparatus 10 includes a ball-hitting assembly 12 which includes a ball-receiving surface 14. A target assembly 16 is provided for receiving a golf ball 18 hit from a ball-hitting assembly 12. When a second golf chipping game apparatus 11 is employed in a competitive golf chipping game, the target assembly 16 receives a golf ball hit from a second ball-hitting assembly 29 of the second golf chipping game apparatus 11. Alternatively, when only one golf chipping game apparatus of the invention is employed, the target assembly 16 can be removed from the ball-hitting assembly 12 and placed a predetermined distance 15 away from the ball-hitting assembly 12. In this case, the target assembly 16 receives balls hit from the sole ball-hitting assembly 12.

The target assembly 16 includes a first target region 20 which has a first surface area and a second target region 22 which has a second surface area. The second surface area is less than the first surface area. The target assembly 16 includes a layer of cushion material 26 which comprises the first target region 20 and the second target region 22. A first ring of cushion material 28 is placed on the layer of cushion material 26. The first ring of cushion material 28 defines a boundary between the first target region 20 and the second target region 22. A second ring of cushion material 30 is placed on the layer of cushion material 26. The second ring of cushion material 30 defines an outer boundary of the first target region 20.

A connection assembly 24 is provided for connecting the ball-hitting assembly 12 to the target assembly 16 in a storage mode. The connection assembly 24 includes a hinge assembly 40 connected between an edge portion 42 of the ball-hitting assembly 12 and an edge portion 44 of the target assembly 16. The hinge assembly 40 keeps the ball-hitting assembly 12 and the target assembly 16 connected together when they are in the playing mode. Also, the hinge assembly 40 keeps the ball-hitting assembly 12 and the target assembly 16 connected together when they are in the storage mode. The hinge assembly 40 can be a living hinge fabricated from flexible plastic material.

A first handle assembly 32 is connected to the ball-hitting assembly 12 at a first peripheral location 34 of the ball-hitting assembly 12. A second handle assembly 36 is connected to the target assembly 16 at a second peripheral location 38 of the target assembly 16. The first handle assembly 32 and the second handle assembly 36 are placed in registration when the ball-hitting assembly 12 and the target assembly 16 are connected together in the storage mode.

The connection assembly 24 also includes a handle connection assembly for connecting the first handle assembly 32 with the second handle assembly 36 when the ball-hitting assembly 12 and the target assembly 16 are in the storage mode. The handle connection assembly includes a male portion 48 in the ball-hitting assembly 12 and a complementary female portion 50 in the target assembly 16.

In use, a first golf chipping game apparatus 10 and a second golf chipping game apparatus 11 are employed in a competitive golf chipping game. The first golf chipping game apparatus 10 and the second golf chipping game apparatus 11 are spaced apart on a ground or floor surface 13 by a predetermined distance 15. The pair of golf chipping game apparatuses and the ground or floor surface 13 therebetween define a playing area. In playing the game, a first player takes a first turn. In doing so, the first player places a first golf ball 18 on the first ball-hitting assembly 12 of the first golf chipping game apparatus 10. The first player takes a golf club 17 specially designed for making chip shots and hits the first golf ball 18 toward the second target assembly 27 of the second golf chipping game apparatus 11. When the first golf ball 18 rests on the second target region 22 of the second target assembly 27 of the second golf chipping game apparatus 11, the first player receives 6 points. When the first golf ball 18 rests on the first target region 20 of the second target assembly 27 of the second golf chipping game apparatus 11, the first player receives 4 points.

Conversely, when the second player takes a turn, the second player places a second golf ball 19 on the second ball-hitting assembly 29 of the second golf chipping game apparatus 11. The second player takes a golf club 17 specially designed for making chip shots and hits the second golf ball 18 toward the first target assembly 16 of the first golf chipping game apparatus 10. When the second golf ball 18 rests on the second target region 22 of the first target assembly 16 of the first golf chipping game apparatus 10, the second player receives 6 points. When the second golf ball 18 rests on the first target region 20 of the first target assembly 16 of the first golf chipping game apparatus 10, the second player receives 4 points.

More specifically, each player alternately chips their bail and tries to score the most points. The first player to obtain 21 points wins the game. Each player can be provided with a number of color coded balls. For example, the first player can have 6 green golf balls 18, and the second player can have 6 orange golf balls 19. After each round of play, the players can switch ends of the playing area. From two to six players can play the competitive chipping game.

The shapes and dimensions of the golf chipping game apparatus of the invention can be as desired. For example, the following specifications are suitable. The ball-hitting assemblies and the target assemblies are circular.

The first target region 20 is annular, and the second target region 22 is circular placed centrally surrounded by the first target region 20. The diameter of the second target region 22 is 8 inches. The radial width of the annular first target region 20 is 10 inches. The overall diameter of the circular target assembly 16 is 28 inches. The overall diameter of a circular ball-hitting assembly 12 is also 28 inches. The predetermined distance 15 separating the first golf chipping game apparatus 10 and the second golf chipping game apparatus 11 is between 10–30 yards.

The components of the golf chipping game apparatus of the invention can be made from inexpensive and durable metal and plastic materials.

As to the manner of usage and operation of the instant invention, the same is apparent from the above disclosure, and accordingly, no further discussion relative to the manner of usage and operation need be provided.

It is apparent from the above that the present invention accomplishes all of the objects set forth by providing a new and improved golf chipping game apparatus that is low in cost, relatively simple in design and operation, and which may advantageously be used to permit a simulation of chipping and to permit practice of chipping skills. With the invention, a golf chipping game apparatus is provided which gives practice in controlling the swinging force of a golf club. With the invention, a golf chipping game apparatus is provided which in a specific target, provides plural target areas requiring different levels of targeting skill. With the invention, a golf chipping game apparatus is provided which does not include a flag and does not include a self-contained source of illumination. With the invention, a golf chipping game apparatus is provided which includes a platform upon which a chip shot is hit. With the invention, a golf chipping game apparatus provides a golf game that is based on competition in chip shots. With the invention, a golf chipping game apparatus is provided which does not include a complex computing mechanism. With the invention, a golf chipping game apparatus provides a chip shot hitting platform and a chip shot target that can be folded up into a compact combination for storage. With the invention, a golf chipping game apparatus provides two sets of hitting platforms and targets. With the invention, a golf chipping game apparatus provides a golf chipping game that can be played competitively between two or more players and provides game rules and a scoring system for the game.

With respect to the above description, it should be realized that the optimum dimensional relationships for the parts of the invention, to include variations in size, form function and manner of operation, assembly and use, are deemed readily apparent and obvious to those skilled in the art, and therefore, all relationships equivalent to those illustrated in the drawings and described in the specification are intended to be encompassed only by the scope of appended claims.

While the present invention has been shown in the drawings and fully described above with particularity and detail in connection with what is presently deemed to be the most practical and preferred embodiments of the invention, it will be apparent to those of ordinary skill in the art that many modifications thereof may be made without departing from the principles and concepts set forth herein. Hence, the proper scope of the present invention should be determined only by the broadest interpretation of the appended claims so as to encompass all such modifications and equivalents.

What is claimed as being new and desired to be protected by Letters Patent of the United States is as follows:

1. A new and improved golf chipping game apparatus, comprising:

a ball-hitting assembly which includes a horizontal ball-receiving surface, a horizontal target assembly for receiving a golf ball hit from a ball-hitting assembly, said target assembly including a first target region having a first surface area and a second target region having a second surface area, wherein said second surface area is less than said first surface area, a connection assembly for connecting said ball-hitting assembly to said target assembly in a storage mode, said connection assembly including a hinge assembly including a hinge assembly connected between an edge portion of said ball-hitting assembly and an edge portion of said target assembly, said target assembly including a layer of cushion material which comprises said first target region and said second target region, a first ring of cushion material placed on said layer of cushion material, said first ring of cushion material defining an upstanding boundary between said first target region and said second target region, and a second ring of cushion material placed on said layer of cushion material, said second ring of cushion material defining an upstanding outer boundary of said first target region.

2. The apparatus described in claim 1 wherein said ball-hitting assembly is associated with a second golf chipping game apparatus.

3. The apparatus described in claim 1, further including:

a first handle assembly connected to said ball-hitting assembly at a first peripheral location of said ball-hitting assembly, and a second handle assembly connected to said target assembly at a second peripheral location of said target assembly, wherein said first handle assembly and said second handle assembly are placed in registration when said ball-hitting assembly and said target assembly are connected together in said storage mode.

4. The apparatus described in claim 3 wherein said connection assembly includes a handle connection assembly for connecting said first handle assembly with said second handle assembly when said ball-hitting assembly and said target assembly are in said storage mode.

5. The apparatus described in claim 1 wherein said connection assembly permits said target assembly to be separated and located a predetermined distance away from said ball hitting assembly.

6. The apparatus of claim 1 wherein said ball hitting assembly and said target assembly have a complementary circular shape so that they are in registry when in the storage mode.

* * * * *